US011751698B2

(12) United States Patent
Wootten, Jr.

(10) Patent No.: US 11,751,698 B2
(45) Date of Patent: Sep. 12, 2023

(54) SLEEP SYSTEM

(71) Applicant: HomTex, Inc., Vinemont, AL (US)

(72) Inventor: Gerald E. Wootten, Jr., Cullman, AL (US)

(73) Assignee: HomTex, Inc., Cullman, AL (US)

( * ) Notice: Subject to any disclaimer, the term of this patent is extended or adjusted under 35 U.S.C. 154(b) by 0 days.

(21) Appl. No.: 16/037,472

(22) Filed: Jul. 17, 2018

(65) Prior Publication Data

US 2019/0014916 A1 Jan. 17, 2019

Related U.S. Application Data

(60) Provisional application No. 62/533,395, filed on Jul. 17, 2017.

(51) Int. Cl.

| | |
|---|---|
| ***A47C 27/00*** | (2006.01) |
| ***A47G 9/02*** | (2006.01) |
| ***A47C 21/04*** | (2006.01) |

(52) U.S. Cl.

CPC ..... *A47C 27/006* (2013.01); *A47C 21/046* (2013.01); *A47G 9/02* (2013.01); *A47G 9/0253* (2013.01)

(58) Field of Classification Search

CPC ..... A47C 27/006; A47C 27/046; A47G 9/02; A47G 9/0253

See application file for complete search history.

(56) References Cited

U.S. PATENT DOCUMENTS

2005/0150049 A1* 7/2005 Schmidt ..... A61F 7/0097 5/502
2014/0259275 A1* 9/2014 Walvius ..... A47G 9/02 2/84

* cited by examiner

*Primary Examiner* — Eric J Kurilla
(74) *Attorney, Agent, or Firm* — Lorri W. Cooper; Cooper & Maersch LLC

(57) ABSTRACT

A sleep system includes a ticking for a mattress, a bed cover, and a pillow cover. The ticking for a mattress is made of a first material. The ticking and the mattress together have a first set of temperature regulating performance-based properties associated therewith. The bed cover is made of the first material or of a second material having substantially the same temperature regulating performance-based properties as the first set of temperature regulating performance-based properties. The pillow cover is made of the first material, the second material, or of a third material having substantially the same temperature regulating performance-based properties as the first or second set of temperature regulating performance-based properties.

16 Claims, 3 Drawing Sheets

SLEEP SYSTEM

CROSS-REFERENCE TO RELATED APPLICATION

This application claims priority to U.S. Provisional Application No. 62/533,395, filed on Jul. 17, 2017, the disclosure of which is incorporated herein by reference in its entirety.

FIELD

The invention concerns a bed system that utilizes a mattress having an outer ticking layer, a bed pad or bed cover and a pillow cover, all of which having substantially the same properties.

BACKGROUND

There are a number of different types of mattresses including inner-spring mattresses, foam-based mattresses, hybrid mattresses, air mattresses, and water beds. Inner-spring mattresses are the traditional type of mattress. These mattresses use one or more layers of metal coils to provide support and comfort. The coils can be wrapped with foam for enhanced comfort.

Foam-based mattresses include a number of different types, including poly foam, memory foam and latex foam. Foam-based mattresses may also include a combination of different foams, for example a layer of responsive poly foam and a layer of memory foam.

Memory foam mattresses are known to provide good support and pressure relief, but they are also known to absorb heat and can become uncomfortably warm during the night. Latex foam mattresses are known to provide good support, comfort, and cooling. They are very breathable and do not absorb as much heat as memory foam. Latex foam also quickly changes to a new shape as a user moves on the bed.

Phase change materials are also known that may be foam or other materials. Phase change materials (PCMs) work by absorbing body heat and then releasing it at a certain temperature. PCMs continue to absorb heat until the heat source (a user's body) has reached that temperature.

Hybrid mattresses are a blend of different mattress types. They may include a combination of latex and memory foams in order to provide advantageous properties from both types of foam mattresses, such as good comfort, cooling, and responsiveness of latex with the support and pressure relief of memory foam. Other hybrid mattress types combine traditional innerspring coils with varying foams.

Air mattresses typically include one or more bladders for holding air and layers of foam. Water beds typically include a bladder for holding water. They may also include one or more outer layers of foam.

BRIEF DESCRIPTION OF THE DRAWING FIGURES

DETAILED DESCRIPTION

Figure 1:
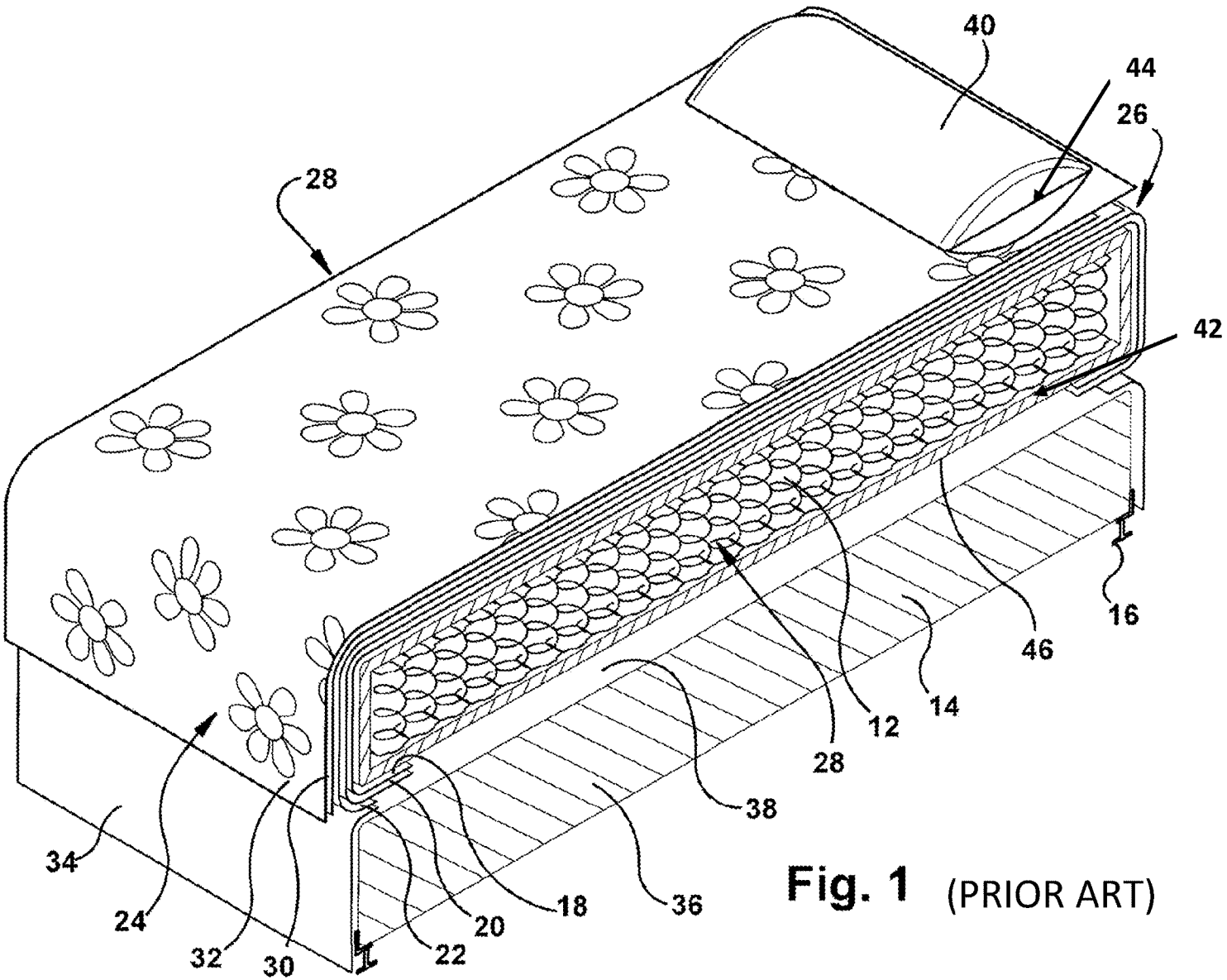
Fig. 1 (PRIOR ART)
FIG. 1 depicts a bed that has various layers of bedding on a mattress.
Figure 2:
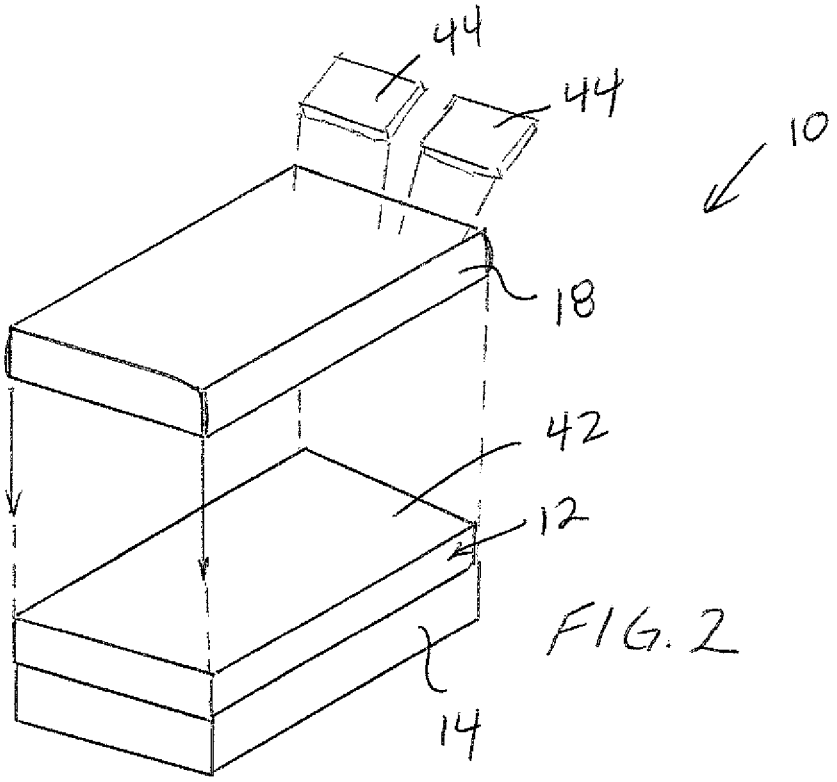
FIG. 2 depicts an example of a sleep system according to the invention.
Figure 3:
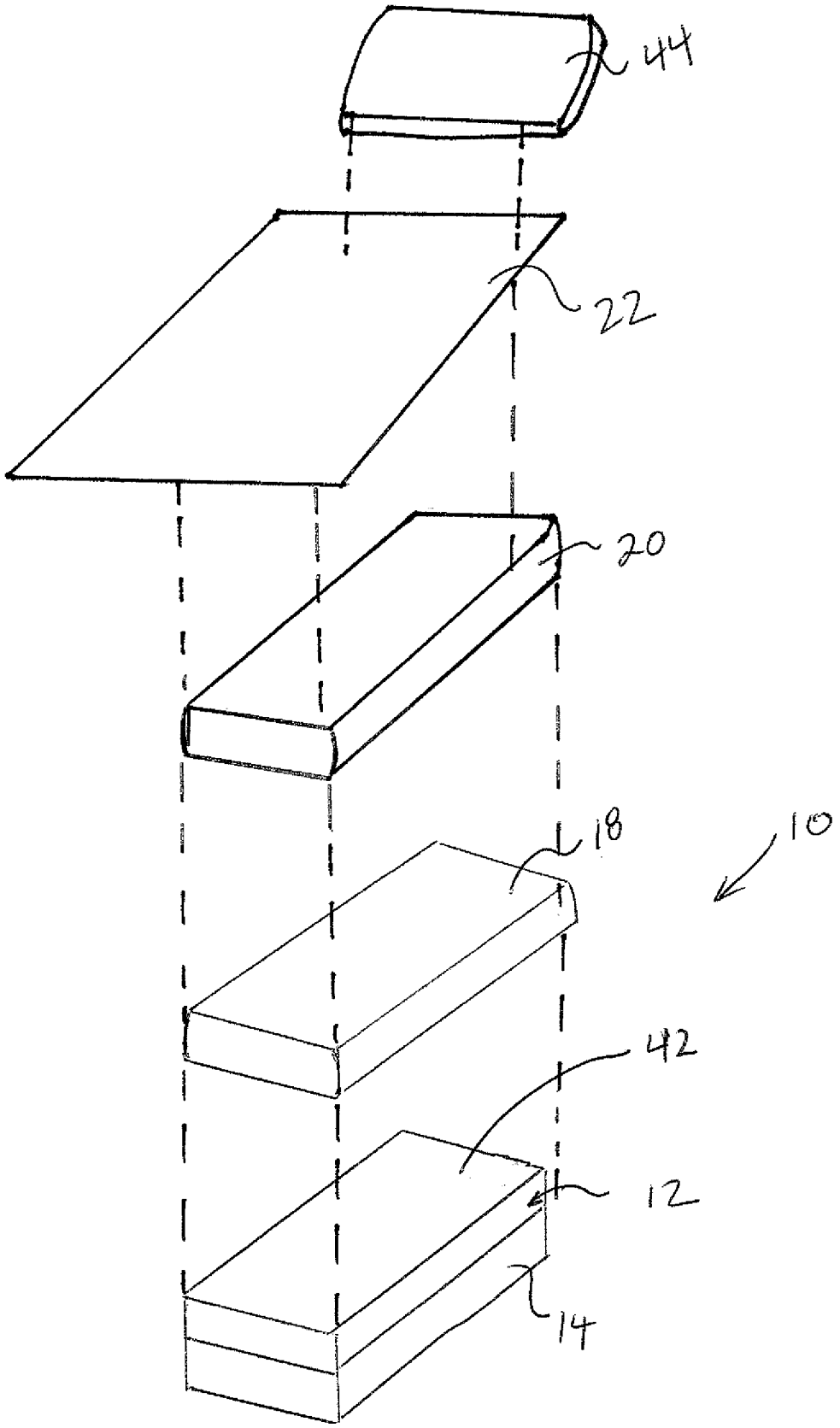
FIG. 3 depicts another example of a sleep system according to the invention.

Consumers invest significant sums when they purchase new mattresses. Mattress manufacturers tout certain properties that are associated with their mattresses. Some examples include environmental properties, like cooling, wicking, breathability and insulating properties.

Memory foam materials have more recently been designed with open cells so that they are more breathable. Surface modified foams in mattresses include foam layers and cores with cuts, contours, channels, and pinholes to improve the amount of airflow that can travel through the layers of the mattress to promote cooling or heating. Vertical or horizontal cores may be used in any of the foam materials to promote airflow. Reticulated foams have been used close to the mattresses outer surface and in the outermost layer of the mattress, known as the ticking layer, when quilted. These also help to promote airflow in the mattress. Some mattresses have fans built into the foundations that blow air into the mattress to promote heating or cooling or both.

Many mattresses sold today have a gel component. One type of gel component is foam infused with gel particles or "beads." Other gel components include swirled gels and foam layered with poured gel. Gel has a higher density than foam and warms more slowly. Adding gel to the top layer of a mattress can provide a consumer with an initial sensation of coolness. Gel may be combined with PCMs, such as layers studded with gel beads or microspheres that contain microencapsulated PCMs.

PCMs can be organic or inorganic compounds that store and release heat as they melt and solidify at certain temperatures. PCMs can be used as topical coatings or blended into foams. Foams, in addition to gels, may be infused with other materials, like copper or graphite. The cooling properties of these foams will depend on the concentration of copper, graphite, or other specialty materials.

In innersprings, coils or springs are typically wrapped in breathable needle-punched non-woven fabrics. Some inner springs include slits or holes punched into the fabrics that surround the springs. Mesh may also be used to wrap coils, promoting maximum airflow.

A typical mattress may offer multiple temperature regulating solutions. For example, an all-foam mattress may have a channeled base foam and surface-modified comfort layers to enable airflow, a layer of netlike reticulated foam below a quilted outer panel, and a cooling gel imbued with a phase change material ("PCM"). The mattress may have a knit ticking panel with PCM fiber or a PCM coating, and bed borders with 3-D "spacer fabric," which provides for additional airflow.

Consumers purchase mattresses based upon these advantageous properties. Then, when they get the mattress home, they put a mattress pad, topper, mattress protector, or a combination thereof over the mattress. If any of these coverings have environmental properties that are different from the mattress, they will override the mattresses properties, making it fruitless to have invested money in a mattress touting these properties. Consumers don't think about how the covering they put on their mattress can actually take away the advantageous environmental properties that are associated with the mattress.

The present invention teaches a bedding system, a where the bedding articles are matched, property-wise to the advantageous environmental properties of the mattress. For example, mattresses can be wicking, meaning that the mattress permits moisture to escape. Mattresses can be cooling and breathable, meaning, for example, that air can flow through the mattress, which assists in cooling and/or heating the occupant. Mattresses can also be insulating, meaning that they keep external environmental factors, such as cold or heat, away from the user. Mattresses can include a combination of any or all of these features, as well as additional features. The present system recognizes the need to match your mattress' properties to your bed covers and pillow so that the consumer can take full advantage of the advantageous environmental temperature-regulating mattress properties.

Referring to FIG. 1, a prior art bed 10 is shown that includes a mattress 12 and box spring 14, with the box spring 14 being positioned on a stand 16. Alternatively, the box spring 14 and mattress 12 could be positioned on a bed frame (not shown). The mattress 12 could be provided without a box spring, if desired. The mattress is encased by ticking 42, which forms the outermost layer of the mattress.

The mattress 12 may be surrounded by a mattress pad 18 and/or a mattress protector. The mattress protector and mattress pad could be integrated into the same article of manufacture. The mattress protector and/or mattress pad may have edges that extend under the mattress 12, between the box spring 14 and mattress 12 and have an outer elastic layer for holding the mattress protector and/or mattress pad around the mattress. The mattress protector and/or mattress pad could simply seat on top of the mattress, if desired, without any surrounding elastic. The mattress protector and/or mattress pad could have elastic bands that can be extended under the mattress or under the corners of the mattress to hold the mattress protector/mattress pad in place on the mattress. A mattress topper (not shown) could be used instead of a mattress pad, or in addition thereto. The lower side of the mattress 46 may also be made of the ticking.

A fitted sheet 20 is shown positioned adjacent the mattress pad 18. The fitted sheet 20 surrounds the mattress pad 18 and has elasticized edges that extend under the mattress 12, between the box spring 14 and the mattress 12. A flat sheet 22 is positioned over the fitted sheet 20. At the bottom end 24 of the mattress 12, the flat sheet 22 is shown tucked under the end 24 of the mattress 12. At the top end 26 of the mattress 12, the flat sheet 22 is positioned on top of the fitted sheet 20 and is spaced from the top end 26 of the mattress 12 to allow a person to lie under the flat sheet 22. Flat sheets 22 may be tucked under one or more of the mattress edges, or may alternatively be left to fall along the sides 28 or bottom end 24 of the mattress 12 without being tucked in. If desired, two flat sheets 22 may be used instead of a fitted sheet 20 and a flat sheet.

A blanket 30 is shown positioned over the flat sheet 22. The blanket 30 is shown falling along the bottom end 24 of mattress 12, but not tucked in under the mattress 12. At the top end 26 of the mattress 12, the blanket 30 is spaced from the top end 26 of the mattress 12 to allow a person to lie under the blanket 30 and flat sheet 22. The blanket 30 may alternatively be tucked in under the mattress 12 along one or more edges 24, 28 of the mattress. A comforter 32 is shown positioned over the blanket 30 and hangs along the sides 28 of the mattress 12. Comforters 32 are not typically tucked in under the mattress 12, but could be, if desired. A duvet cover could surround the comforter if desired (not shown). A coverlet (not shown) could be substituted for the comforter 32.

A dust ruffle 34 is shown extending around the box spring 14. Its upper end is tucked between the mattress 12 and box spring 14, and it is usually the lowest layer of articles between the mattress 12 and box spring 14. The dust ruffle 34 falls around the sides 36, bottom 38, and sometimes top end of the box spring and can hide the box spring 14 from view.

A pillow 40 with sham is shown depicted on top of the comforter 32. More than one blanket, comforter, flat sheet, fitted sheet, dust ruffle, pillow, or other items may also be used in a sleep system, with the typical articles being depicted.

As discussed above, the outer later of a mattress is its ticking 42. The mattress ticking 42 is an overlooked aspect of the mattress' functionality. The ticking 42 plays a major role in the functionality of the mattress 12, such as how cool or hot a mattress 12 sleeps. In general, the ticking 42 can only be as cool as the foam and coil layers below.

Ticking 42 has historically been a cotton or linen textile that was tightly woven for durability and to prevent down feathers from poking through the fabric. It commonly had a striped design against a plain, neutral background. Ticking 42, however, is no longer restricted to traditional cotton or linen textiles. Ticking 42 can be made of natural and synthetic fabrics. The term ticking 42 is used herein to describe the outer-most layer of a mattress 12. It can have any number of different properties, including those of historical ticking 42 layers, as well as those of new fabrics that feature different advantageous properties over standard cotton and wool materials.

There are two types of ticking 42—non-quilted and quilted. Non-quilted ticking 42 covers are thin covers and are the most popular and widely used covers on many online mattresses because they are less expensive than quilted covers. They also offer better breathability because they are made with less material than a quilted cover. Quilted covers offer a more traditional look and feel. They tend to make the mattress 12 seem hotter because they have more material than a non-quilted cover. Often, a thin low-density memory foam or poly foam is quilted into the cover.

The ticking 42 can also incorporate PCMs. For example, woven, high-end fabrics can be made with yarns that contain microencapsulated PCMs. PCMs are often knit, coated or woven into ticking 42 to promote coolness of the consumer. Knits used for ticking 42 may also be woven to have holes or grids to promote airflow. The holes or grids can be aligned with channels or perforations in the bed's foam core. Ticking 42 may also be embedded with metal fibers, such as copper or titanium flecks, and connected to a control panel with specialized software to adjust a home's heating/cooling system based upon a user's body temperature. Flecks of metal could be incorporated into the foam. Other metal, such as quartz or mica, could be incorporated into the foam.

PCMs may be designed to retain body heat until the sleeper's body reaches a certain temperature, at which point it stops absorbing heat. This allows the PCMs to maintain a steady, moderately cool temperature regardless of how much body heat the sleeper is emitting. PCMs may not sleep as cool as a non-quilted cover, but may effectively keep the heat down during sleep. Other materials may be used that help to wick away moisture, such as lycra spandex.

The mattress ticking 42 along with its internal layers largely contribute to a mattress' cooling abilities. Fabric-blend covers, coil springs, gel foam, memory foam—all these factors, including those discussed above, determine how efficiently a cooling mattress 12 can facilitate air circulation and its ability to move heat away from a consumer's body.

The sleep system described herein includes a ticking 42 layer associated with the mattress 12. The ticking 42 layer is made of a first material that has a first set of properties. The ticking 42 is a temperature regulating performance based fabric. The ticking 42 layer may be removable or replaceable, by using a means to permit removal of the ticking 42 from the mattress 12, such as a zipper or other closure.

Alternatively, the ticking 42 may be a permanent part of the mattress 12 and non-removable.

The sleep system also includes a bed cover, also referred to herein as a bottom layer. The bed cover may be a mattress cover, a mattress pad, a mattress protector, a mattress encasement, a mattress topper, or a combination thereof. The bottom layer is made of either the first material having a first set of properties, or of a second material that has substantially the same properties as the first set of properties. The second material is also a temperature regulating performance based fabric. Bed covers are used primarily to prevent stains and add another layer of cleanliness. Bed covers can also be quilted and/or include additional padding. Bed covers can be waterproof, water-resistant, or non-waterproof. Bed covers can be a single sheet, covering only the top of the ticking 42 of the mattress 12, or bed covers could cover three-sides, five-sides, or be an encasement of the entire mattress 12. The fabric associated with the bed cover can be woven, knit or non-woven.

The sleep system also includes a pillow cover 44. The pillow cover 44 is the layer that encloses the pillow materials and is different from a pillow case. A pillow case is typically a sleeve that a pillow is inserted into. A pillow case is typically the same type of material as the sheets. The pillow cover 44 of the present system is made of the first material, the second material, or of a third material that is different from the first and second materials, but that has the same set of properties as the first set of properties. The third material is also a temperature regulating performance based fabric. The fabric associated with the pillow cover 44 can be woven, knit or non-woven.

By providing the sleep system herein, the properties of the mattress 12 are designed into the bedding so that the bedding does not hinder or inhibit the properties for which the mattress 12 is purchased by a user. The system provides the user with the same or substantially the same comfort/technology story aligned throughout the purchase process.

Some mattresses require users to use a mattress protector to maintain the warranty of the mattress 12. For a mattress 12 having drying and cooling properties, for example, such as utilizing a PCM to keep the user cool during sleep, placement of a laminated mattress 12 protector on the mattress 12 would completely negate the properties associated with the mattress 12, namely the cooling and dryness properties of the mattress 12. The present system provides a user with a system that permits the properties associated with the mattress 12 to carry through to the bedding articles so that the benefits associated with the mattress 12 are carried through to the bedding articles by utilizing materials having the same or substantially the same properties as the sleep story.

The basic system includes ticking 42 and a bed cover, or ticking 42 and a pillow cover 44, or ticking 42, a bed cover, and a pillow cover 44. In addition, other parts of the system may be included such as additional bed covers, sheets, blankets, comforters and duvets that incorporate the same properties as the first properties. These additional items may be used singly or in combination.

A sleep system according to the invention may include a ticking 42 for a mattress 12, a bed cover, and a pillow cover 44. The ticking 42 may be made of a first material, with the ticking 42 and the mattress 12 together having a first set of temperature regulating performance-based properties associated therewith. The bed cover may be made of the first material or of a second material having substantially the same temperature regulating performance-based properties as the first set of temperature regulating performance-based properties. The pillow cover 44 is made of the first material, the second material, or of a third material having substantially the same temperature regulating performance-based properties as the first or second set of temperature regulating performance-based properties.

The bed cover may be one or more of a mattress protector, a mattress encasement, a mattress pad, or a mattress topper. The pillow cover 44 may be permanently associated with the pillow or may be removable from the pillow via a zipper or other attachment means. The first set of properties are temperature regulating performance-based properties that include one or more of cooling, heating, breathability and wicking properties.

The system may also include a fitted sheet, a flat sheet, and a pillow case made of a material that has properties that are substantially the same as the first set of temperature regulating performance-based properties. The system may also include a comforter made of a material that has properties that are substantially the same as the first set of temperature regulating performance-based properties. The system may include a fitted sheet, a flat sheet, a pillow case, a blanket, and a comforter, each made of a material that has properties that are substantially the same as the first set of temperature regulating performance-based properties.

In another embodiment, a sleep system includes a ticking 42 for a mattress 12 and a bed cover. The ticking 42 for a mattress 12 is made of a first material. The ticking 42 and the mattress 12 together have a first set of temperature regulating performance-based properties associated therewith. The bed cover is made of the first material or of a second material having substantially the same temperature regulating performance-based properties as the first set of temperature regulating performance-based properties.

In another embodiment, a sleep system includes a ticking 42 for a mattress 12 and a pillow cover 44. The ticking 42 for a mattress 12 is made of a first material. The ticking 42 and the mattress 12 together have a first set of temperature regulating performance-based properties associated therewith. The pillow cover 44 is made of the first material or of a second material having substantially the same temperature regulating performance-based properties as the first set of temperature regulating performance-based properties.

Smart fabrics could be utilized, if desired, such as those that convert sunlight into stored energy and that conduct the energy as a charging device or to emit lights without any other outside influence. Smart fabrics could also be used to collect data and send this data to a phone or make a call, or to a fitness device. Smart fabrics could incorporate fibers that can detect an injury and administer medicine. In general, smart fabrics interact with outside influences and modify, relay, or react to the influences. Smart fabrics can take outside influences and can cause a secondary or tertiary action.

The fabrics utilized in the system may be natural or synthetic; woven, knitted, or non-woven; and quilted or non-quilted. Other types of fabrics may be utilized. Any types of materials can be used, such as wool, cotton, cotton and wool blends, polyester, synthetics, organics and non-organics and other materials. Materials may be treated with PCMs or include woven in minerals or metals.

In addition to the temperature regulating performance-based properties discussed above, the first, second and third materials may also include fabrics that are infused with herbs, anti-microbial properties, anti-bacterial properties, and other enhancements.

The term "substantially," as used herein, is a term of estimation.

While various features are presented above, it should be understood that the features may be used singly or in any combination thereof. Further, it should be understood that variations and modifications may occur to those skilled in the art to which the claimed examples pertain. The examples described herein are exemplary. The disclosure may enable those skilled in the art to make and use alternative designs having alternative elements that likewise correspond to the elements recited in the claims. The intended scope may thus include other examples that do not differ or that insubstantially differ from the literal language of the claims. The scope of the disclosure is accordingly defined as set forth in the appended claims.

What is claimed is:

1. A sleep system comprising:

a mattress having a ticking made of a first material, at least one layer of foam therein, and one or more optional layers of coils therein, wherein the ticking and the mattress together have a first set of performance-based properties associated therewith; and a bed cover having one or more layers that together provide a second set of performance-based properties, wherein the second set of performance-based properties have substantially the same performance-based properties as the first set of performance-based properties.

2. The sleep system of claim 1, wherein the bed cover is one or more of a mattress protector, a mattress encasement, a mattress pad, or a mattress topper.

3. The sleep system of claim 1, wherein the first set of properties are performance-based properties that include one or more of cooling, heating, breathability, and wicking properties.

4. The sleep system of claim 1, further comprising a fitted sheet, a flat sheet, and a pillowcase made of a material that has properties that are substantially the same as the first set of performance-based properties.

5. The sleep system of claim 1, further comprising a comforter made of a material that has properties that are substantially the same as the first set of performance-based properties.

6. The sleep system of claim 1, further comprising a fitted sheet, a flat sheet, a pillowcase, a blanket, and a comforter, each made of one or more materials that have properties that are substantially the same as the first set of performance-based properties.

7. The sleep system of claim 1, wherein the ticking is a fabric that may or may not be quilted.

8. The sleep system of claim 1, wherein the bed cover is a fabric that may or may not be quilted.

9. A sleep system comprising:

a mattress having a ticking covering the mattress made of a first material and at least one layer of foam positioned therein, and one or more optional layers of coils, wherein the ticking and the mattress together have a first set of performance-based properties associated therewith; and a pillow cover having one or more layers that together provide a second set of performance-based properties, wherein the second set of performance-based properties have substantially the same performance-based properties as the first set of performance-based properties.

10. The sleep system of claim 9, wherein the pillow cover is permanently associated with a pillow or is removable from the pillow via a zipper or other attachment means.

11. The sleep system of claim 9, wherein the pillow cover is a fabric that may or may not be quilted.

12. The sleep system of claim 9, wherein the first set of properties are performance-based properties that include one or more of cooling, heating, breathability, and wicking properties.

13. The sleep system of claim 9, further comprising a fitted sheet, a flat sheet, and a pillowcase made of a material that has properties that are substantially the same as the first set of performance-based properties.

14. The sleep system of claim 9, further comprising a comforter made of a material that has properties that are substantially the same as the first set of performance-based properties.

15. The sleep system of claim 9, further comprising a fitted sheet, a flat sheet, a pillowcase, a blanket, and a comforter, each made of one or more materials that have properties that are substantially the same as the first set of performance-based properties.

16. The sleep system of claim 9, wherein the ticking is a fabric that may or may not be quilted.

* * * * *